US006223459B1

(12) United States Patent
Hengstenberg

(10) Patent No.: US 6,223,459 B1
(45) Date of Patent: May 1, 2001

(54) SAFETY MECHANISM FOR SIDE HAMMER MUZZLELOADING RIFLES

(75) Inventor: Eric T. Hengstenberg, Centerville, IA (US)

(73) Assignee: Ebsco Industries, Inc., Birmingham, AL (US)

( * ) Notice: Subject to any disclaimer, the term of this patent is extended or adjusted under 35 U.S.C. 154(b) by 0 days.

(21) Appl. No.: 09/347,588

(22) Filed: Jul. 1, 1999

(51) Int. Cl.[7] ..... F41A 17/26
(52) U.S. Cl. ..... 42/51; 42/70.08
(58) Field of Search ..... 42/51, 70.08; 89/1.3

(56) References Cited

U.S. PATENT DOCUMENTS

| | | | | |
|---|---|---|---|---|
| 1,256,631 | * | 2/1918 | Zeymer | 42/70.08 |
| 3,577,667 | * | 5/1971 | Kern | 42/51 |
| 4,989,357 | | 2/1991 | Norman et al. | 42/70.08 |
| 5,067,266 | * | 11/1991 | Findlay | 42/70.08 |
| 5,678,341 | | 10/1997 | Kahnke | 42/51 |

FOREIGN PATENT DOCUMENTS

| | | | | |
|---|---|---|---|---|
| 448500 | * | 6/1936 | (GB) | 42/51 |

* cited by examiner

*Primary Examiner*—Stephen M. Johnson

(74) *Attorney, Agent, or Firm*—Zarley, McKee, Thomte, Voorhees & Sease

(57) ABSTRACT

A safety mechanism for a muzzleloading rifle has a firing hammer pivotally mounted on the rifle and is movable between a rearward cocked position and a forward firing position, and is releasably held by a trigger mechanism in the cocked position when manually moved to the cocked position. The firing hammer includes an arm portion extending away from the pivotal connection between the hammer and the rifle. An elongated safety bolt is slidably mounted in a transverse direction in the rifle and is movable between an outer safety position and an inner non-safety position, and is located within a pivotal path of the arm portion of the hammer to engage the arm to prevent the forward rotation of the hammer to move to the firing position if the hammer is released for forward pivotal movement by the trigger mechanism. The safety bolt is selectively manually slidable into the rifle by the user to remove it from the safety position in the pivotal path of the arm portion so as to prevent the hammer to pivot toward the firing position when released by the trigger assembly. The safety bolt has a plurality of annular grooves therein which must be aligned with tangs on the rear end of the rifle barrel when the barrel is being removed from or inserted into the rifle. The alignment of these components is only possible when the safety bolt is in the safety position. A spring loaded plunger is engagable with the safety bolt at times to hold it in the safety mode when required. A detent also engages spaced annular grooves on the safety bolt to stabilize the position of the safety bolt in either the safety or non-safety positions.

10 Claims, 10 Drawing Sheets

9-9

SAFETY MECHANISM FOR SIDE HAMMER MUZZLELOADING RIFLES

BACKGROUND OF THE INVENTION

Modern muzzleloading rifles often use the side hammer design of the very old muzzleloading rifles either with an ignition flint or a more modern ignition system. However, neither the old or more modern side hammer rifles are relatively safe. At best, they have a thumb safety mechanism which might break or even become disengaged if the rifle is dropped. Further, it is possible to disassemble and assemble these rifles when the safety is not engaged, thus creating a possible ignition of the rifle in a state of disassembly. These rifles are all difficult to clean.

It is therefore a principal object of this invention to provide a safety mechanism for side hammer muzzleloading rifles that has a cross bolt safety.

A further object of this invention is to provide a safety mechanism for side hammer muzzleloading rifles that has a cross bolt safety which prevents the barrel from being disassembled or assembled without the safety being engaged.

A still further object of this invention is to provide a safety mechanism for side hammer muzzleloading rifles that requires that a removable breech plug be assembled within the rifle before the safety can be moved to a firing position.

A still further object of this invention is to provide a safety mechanism for side hammer muzzleloading rifles which will not disengage the safety upon being dropped, and which will not have a safety that will break upon being dropped.

These and other objects will be apparent to those skilled in the art.

SUMMARY OF THE INVENTION

A safety mechanism for a muzzleloading rifle has a firing hammer pivotally mounted on the rifle and is movable between a rearward cocked position and a forward firing position, and is releasably held by a trigger mechanism in the cocked position when manually moved to the cocked position.

The firing hammer includes an arm portion extending away from the pivotal connection between the hammer and the rifle. An elongated safety bolt is slidably mounted in a transverse direction in the rifle and is movable between an outer safety position and an inner non-safety position, and is located within a pivotal path of the arm portion of the hammer to engage the arm to prevent the forward rotation of the hammer to move to the firing position if the hammer is released for forward pivotal movement by the trigger mechanism.

The safety bolt is selectively manually slidable into the rifle by the user to remove it from the safety position in the pivotal path of the arm portion so as to prevent the hammer to pivot toward the firing position when released by the trigger assembly. The safety bolt has a plurality of annular grooves therein which must be aligned with tangs on the rear end of the rifle barrel when the barrel is being removed from or inserted into the rifle. The alignment of these components is only possible when the safety bolt is in the safety position.

A detent also engages spaced annular grooves on the safety bolt to stabilize the position of the safety bolt in either the safety or non-safety positions.

DESCRIPTION OF THE PREFERRED EMBODIMENT

Figure 1:
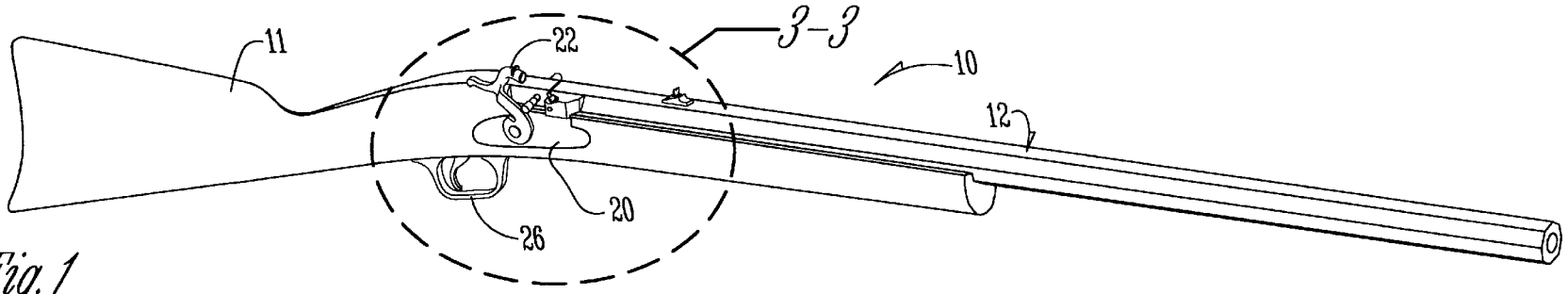
FIG. 1 is a perspective view of the rifle of this invention.
Figure 2:
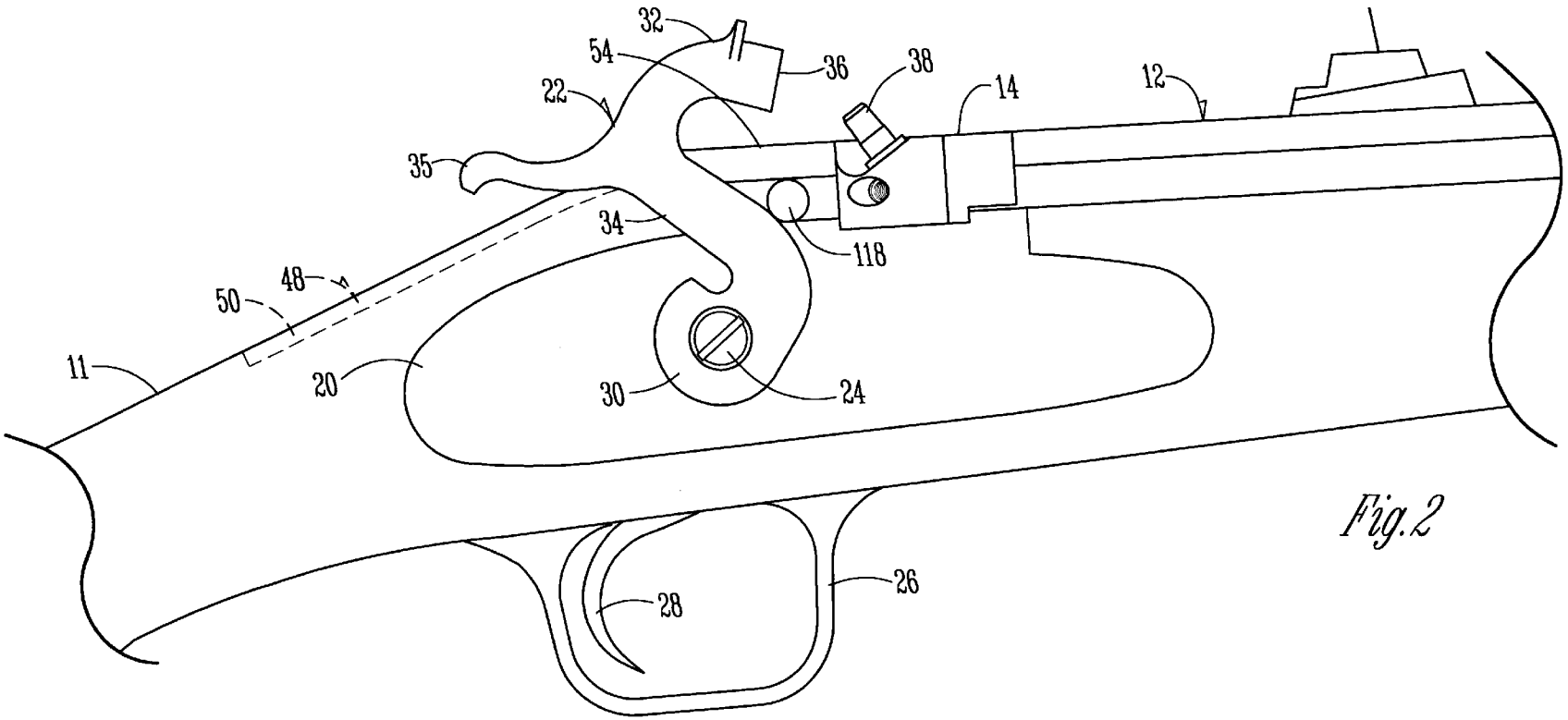
FIG. 2 is a partial side elevation thereof taken at an enlarged scale showing the side hammer in a safety position.
Figure 3:
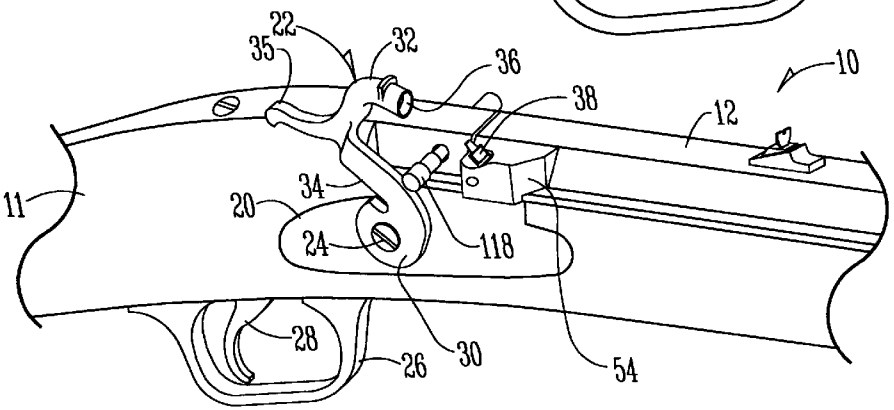
FIG. 3 is an enlarged scale partial perspective view taken on line 3—3 of FIG. 1.
Figures 4, 5, 6:
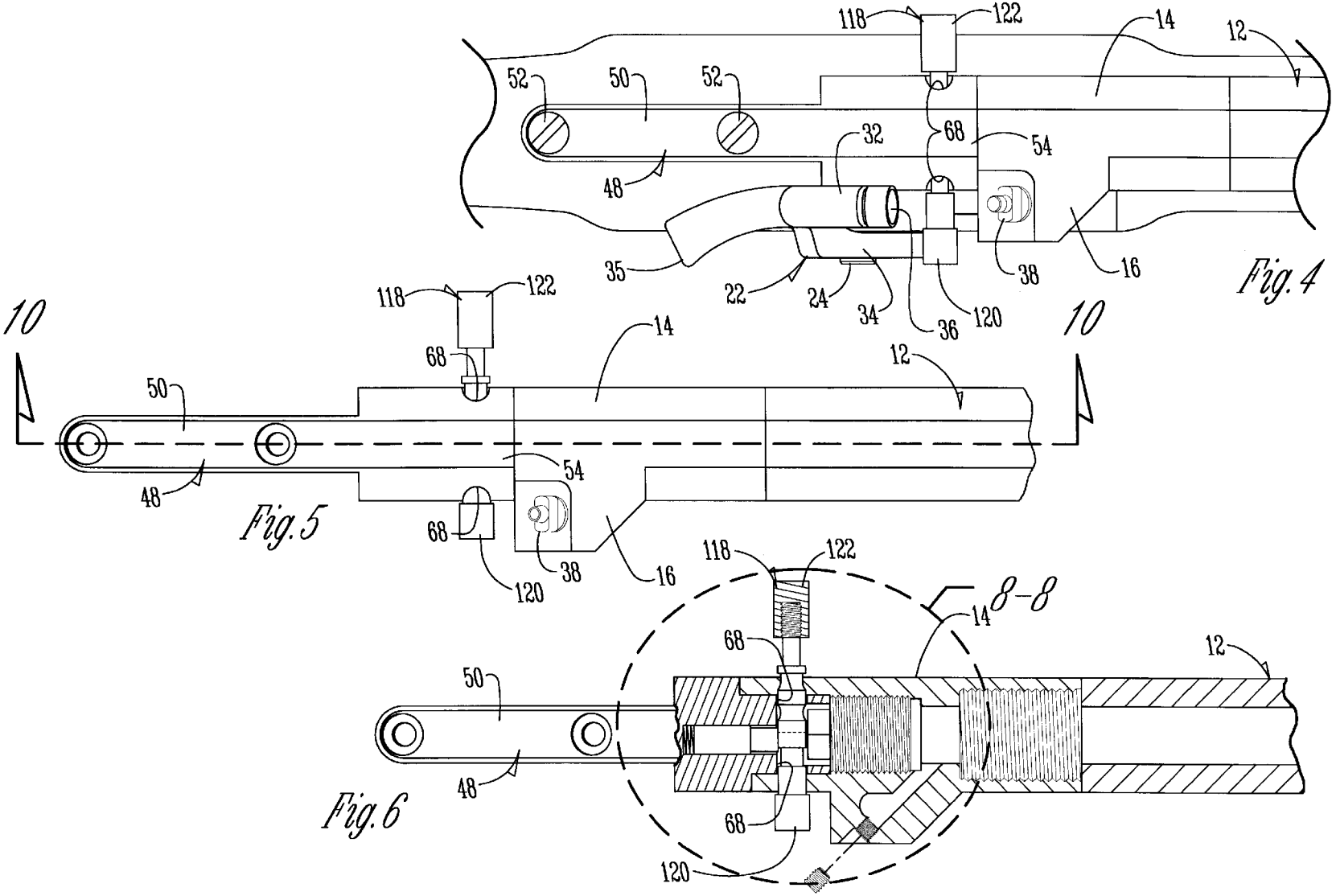
FIG. 4 is a partial top plan view shown at an enlarged scale of FIG. 3.
FIG. 5 is a plan view similar to that of FIG. 4 with the stock of the rifle having been removed.
FIG. 6 is a partial sectional view of the components of FIG. 5.
Figure 10:
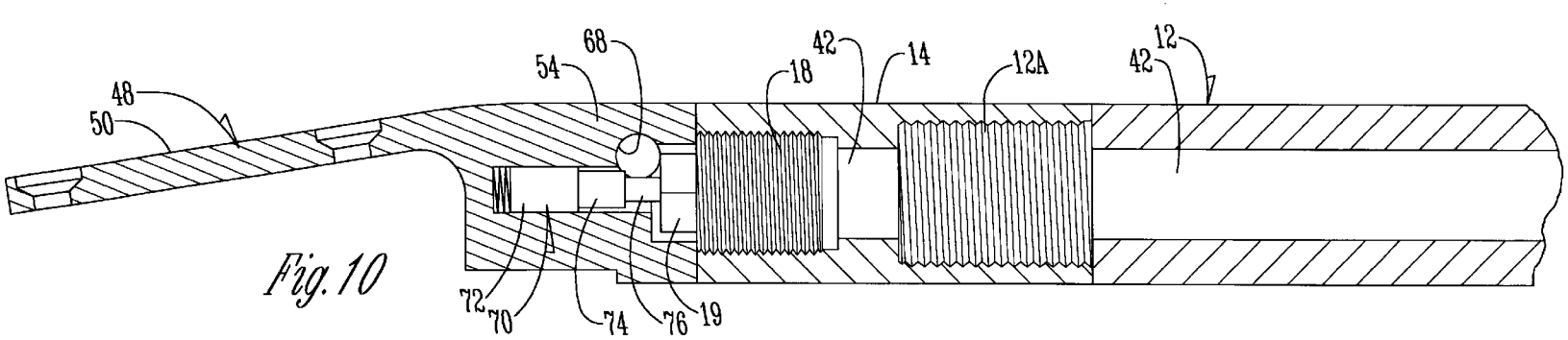
FIG. 10 is an enlarged scale sectional view taken on line 10—10 of FIG. 5.

With reference to FIGS. 1, 2 and 3, the numeral 10 designates a muzzleloading rifle having a conventional stock 11, barrel 12 and breech member 14 with has a lateral hooked breech projection 16. A breech plug 18 having a rearwardly extending nut 19 is threadably mounted within the rearward end of the breech member 14. The breech member 14 can be threadably mounted on a threaded projection 12A on the rearward end of barrel 12 (FIG. 10). An elongated flat mounting plate 20 is located on the right hand side of the stock 11 adjacent the breech member 14. Barrel 12 is rigidly secured to breech member 14.

A side hammer 22 is pivotally secured to mounting plate 20 by pivot screw 24 (FIG. 2). A conventional trigger assembly 26 with trigger 28 is conventionally and operatively connected to the side hammer 22. The side hammer 22 as shown in FIG. 2, is in its rearward cocked pivotal position and is releasably held in this position by conventional means to trigger 28. Conventionally, the side hammer is biased by a spring mechanism (not shown) to move to a forward firing position (FIG. 2A) when conventionally released by trigger 28. This invention deals with a safety bolt to selectively prevent the forward pivoting action of the side hammer from the cocked position in FIG. 2 to the firing position of FIG. 2A even though the side hammer may be released for pivotal action by the trigger 28.

Figures 6A, 7, 7A:
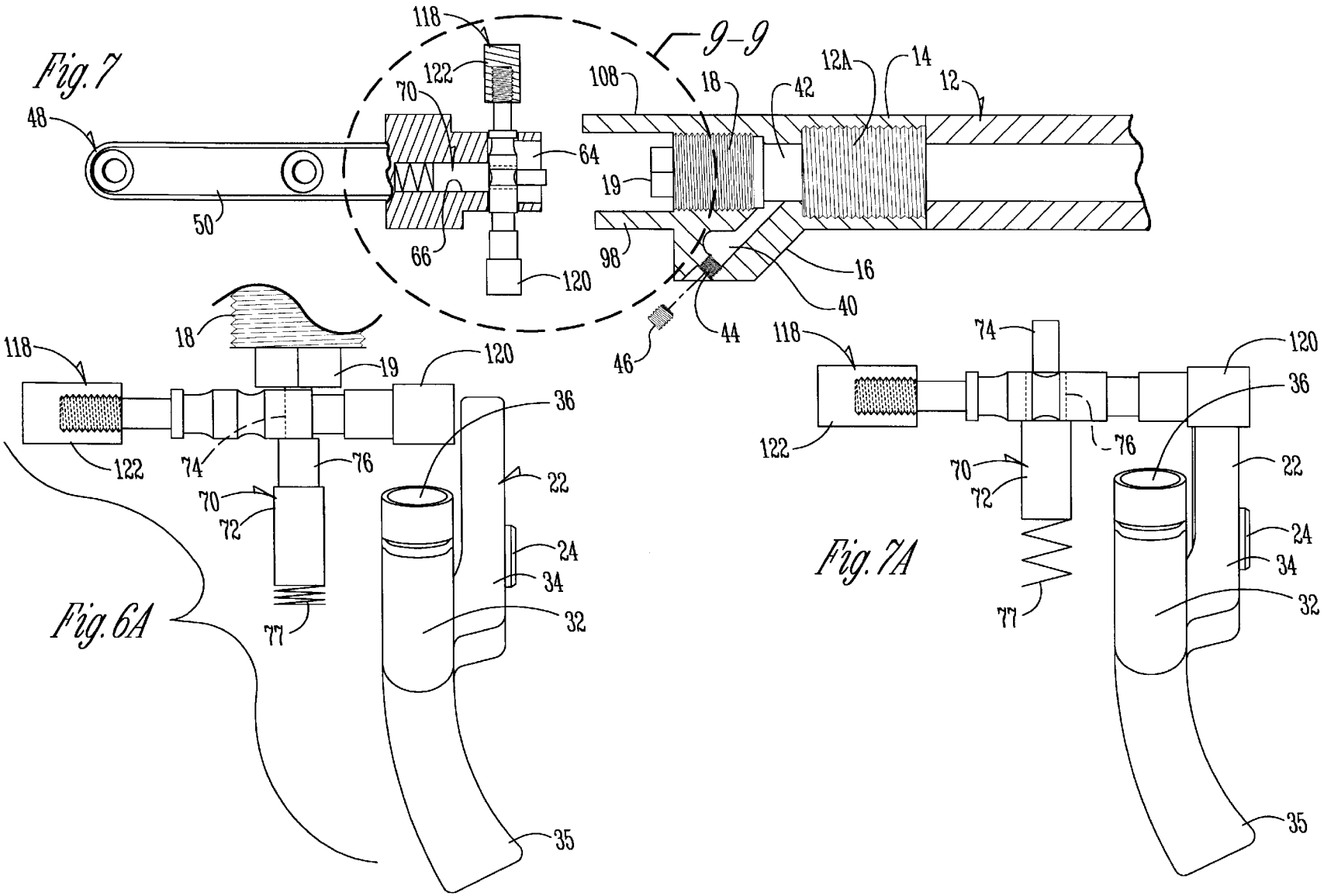
FIG. 6A is a top plan view of the safety bolt in a non-safety position with respect to the hammer.
FIG. 7 is an exploded view similar to that of FIG. 6 with the rifle barrel and receiver being removed from the safety bracket.
FIG. 7A is a view similar to that of FIG. 6A with the safety bolt being in its safety position.
Figure 9:
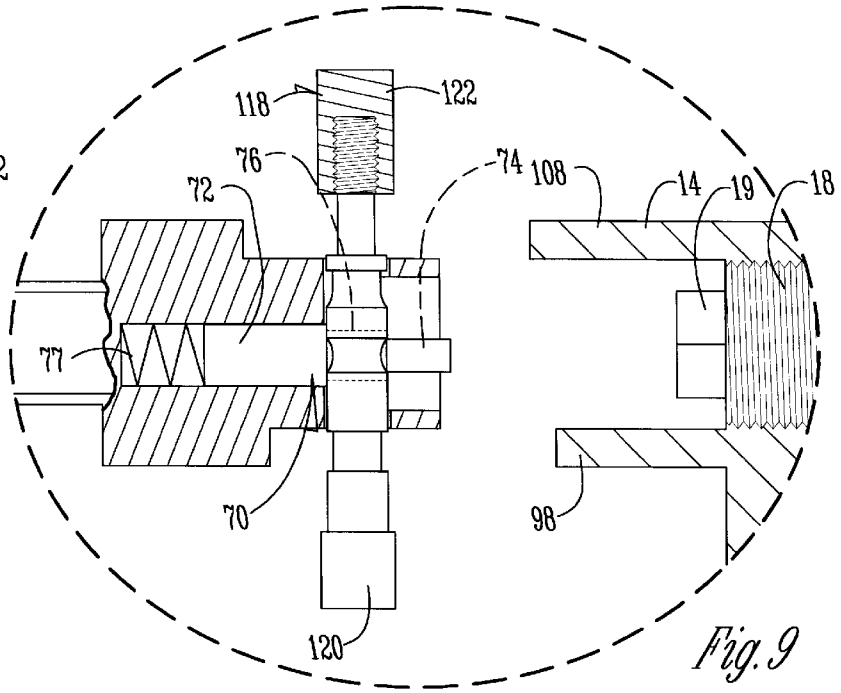
FIG. 9 is an enlarged scale sectional view taken on line 9—9 of FIG. 7.

The side hammer 22 is S-shaped and has a lower hook portion 30 (FIG. 2), an upper hook portion 32, a center straight arm 34 and a cocking lever 35. The upper hook portion terminates in a firing aperture 36 which is adapted to receive and impact the conventional nipple 38 which extends diagonally upwardly and rearwardly from the lateral hook breech projection 16 (FIG. 2). The nipple 38 is associated with the flash passage 40 (FIG. 8) which is located in the breech projection 16. The flash passage 40 is in communication with barrel opening 42 and has a rearward open end 44 (FIGS. 7 and 8) which can be selectively closed by screw 46 (FIG. 7). Screw 46 upon removal permits cleaning and maintenance of the flash passage 40.

Figure 20:
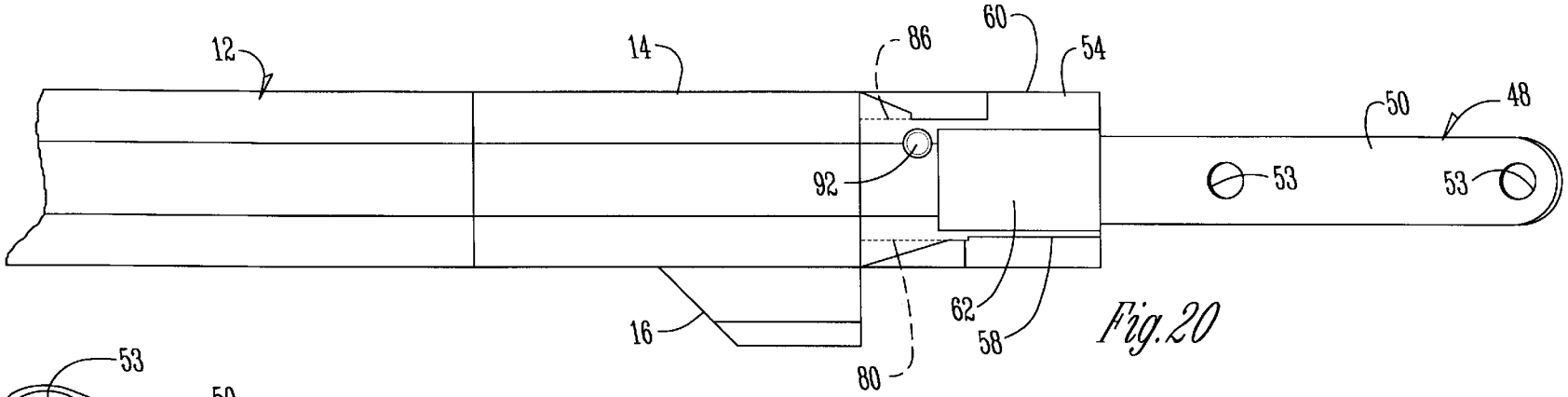
FIG. 20 is a bottom plan view of the safety bracket.
Figure 22:
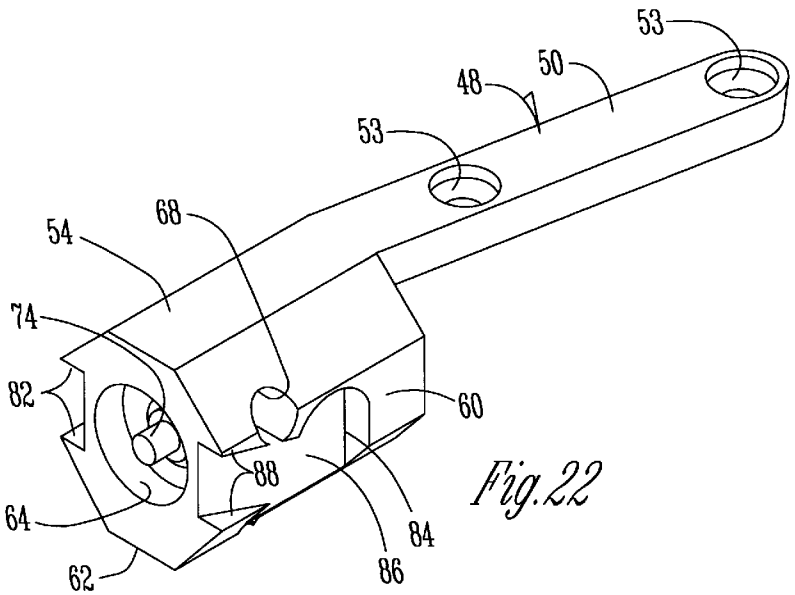
FIG. 22 is a perspective view of the safety bracket similar to that of FIG. 21 but taken at a different angular position.
Figure 21:
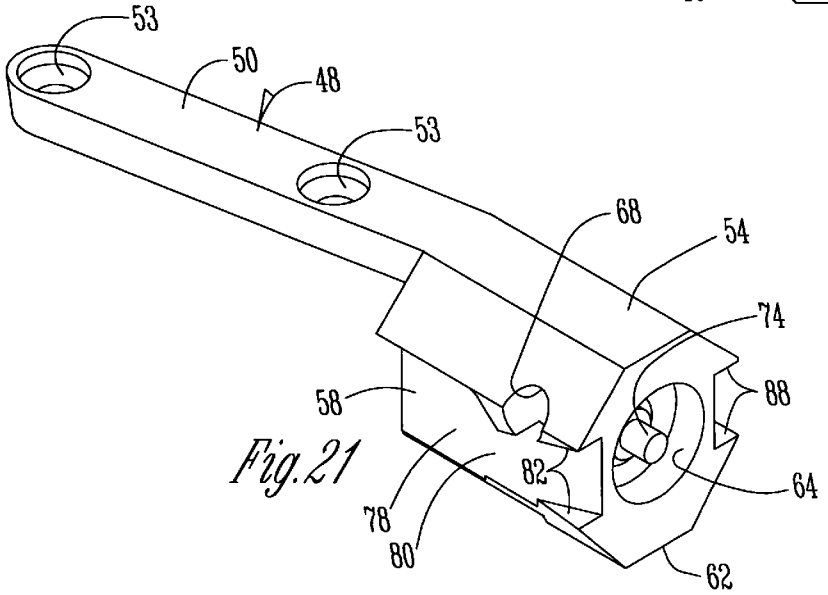
FIG. 21 is a reduced scale perspective view of the safety bracket.

A safety bracket 48 is best shown in FIGS. 20–22. It has a rearwardlly extending flange arm 50 which is secured to the upper and rearward portion of stock 11 by screws 52 which extend through apertures 53. The forward end of bracket 48 terminates in body member 54 which is octagonal in cross section and which has top 56, a first side 58 (adjacent side hammer 22), a second side 60 (opposite to the side hammer 22), and bottom 62. The numeral 64 designates a hollow open end in the body member 54 which terminates in a rearwardly extending bore 66 of lesser diameter. A lateral bore 68 is shown best in FIGS. 21 and 22 and is in communication with the open end 64 and the bore 66. As shown in FIG. 6, 7, 8 and 9, a plunger 70 is slidably mounted in bore 66 and is comprised of a large diameter rearward end 72, a smaller diameter forward end 74, and a center portion 76 therebetween of medium diameter. Spring 77 urges plunger 70 forwardly.

As best shown in FIGS. 21 and 22, the body member 54 has a recess 78 formed in side 58 directly below lateral bore 68. A tapered slot 80 is located in recess 78 and has parallel diagonally extending upper and lower edges 82.

Similarly, a recess 84 is formed in the opposite side 62 of body member 54, and it also is located slightly below but intersects the lateral bore 68. A tapered slot 86 is formed in recess 84 and has parallel upper and lower edges 88.

Figure 17:
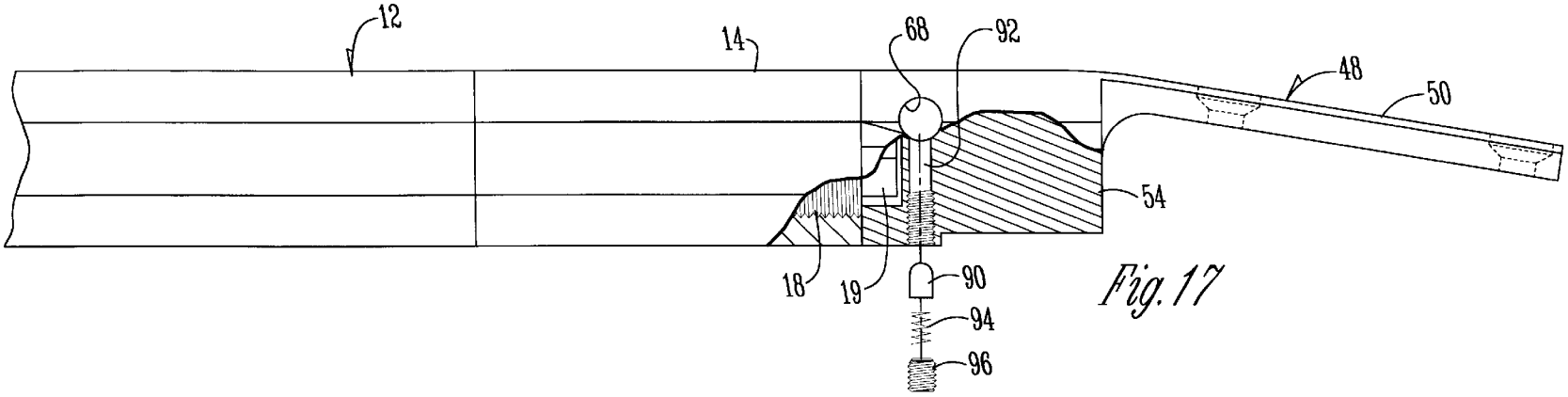
FIG. 17 is a partial sectional view similar to that of FIG. 11 but showing details of the detent that holds the safety bolt in position.
Figure 19:
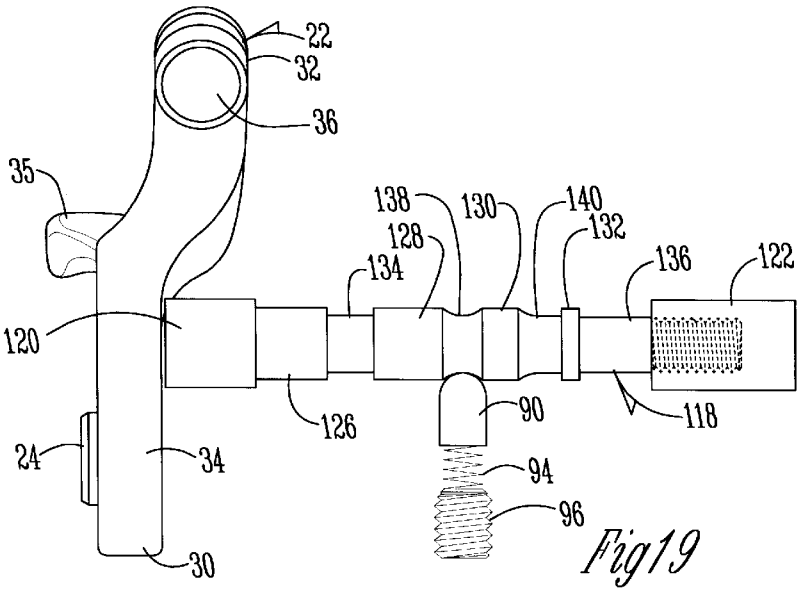
FIG. 19 is a view similar to that of FIG. 18 but shows the hammer and the safety bolt in a non-safety position.
Figure 18:
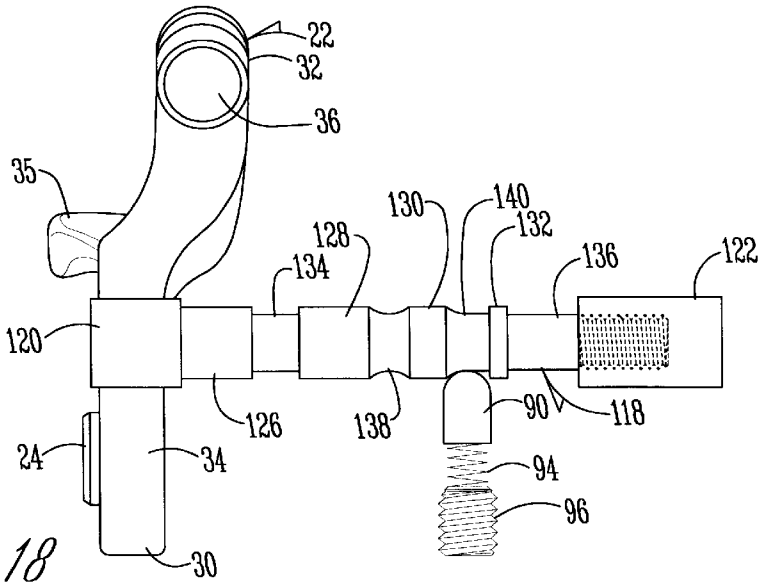
FIG. 18 is a front elevational view of the safety bolt and the hammer when the hammer is in its safety position.

A detent plunger 90 is positioned in vertical aperture 92 in body member 54 as best shown in FIGS. 17–19. Aperture 92 is threaded at its lower end and receives spring 94 which bears upward pressure against the plunger 90 as caused by the screw 96 that is located in the lower end of aperture 92. The detent plunger 90 bears against the safety bolt of this invention as will be described hereafter.

Figure 12:
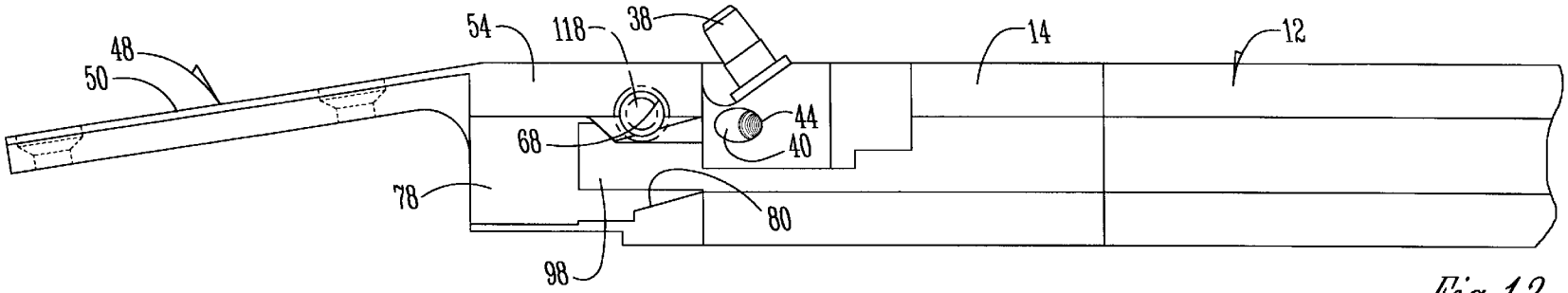
FIG. 12 is a side elevation similar to that of FIG. 11 but taken from the opposite side of the safety bracket and the barrel.
Figure 12A:
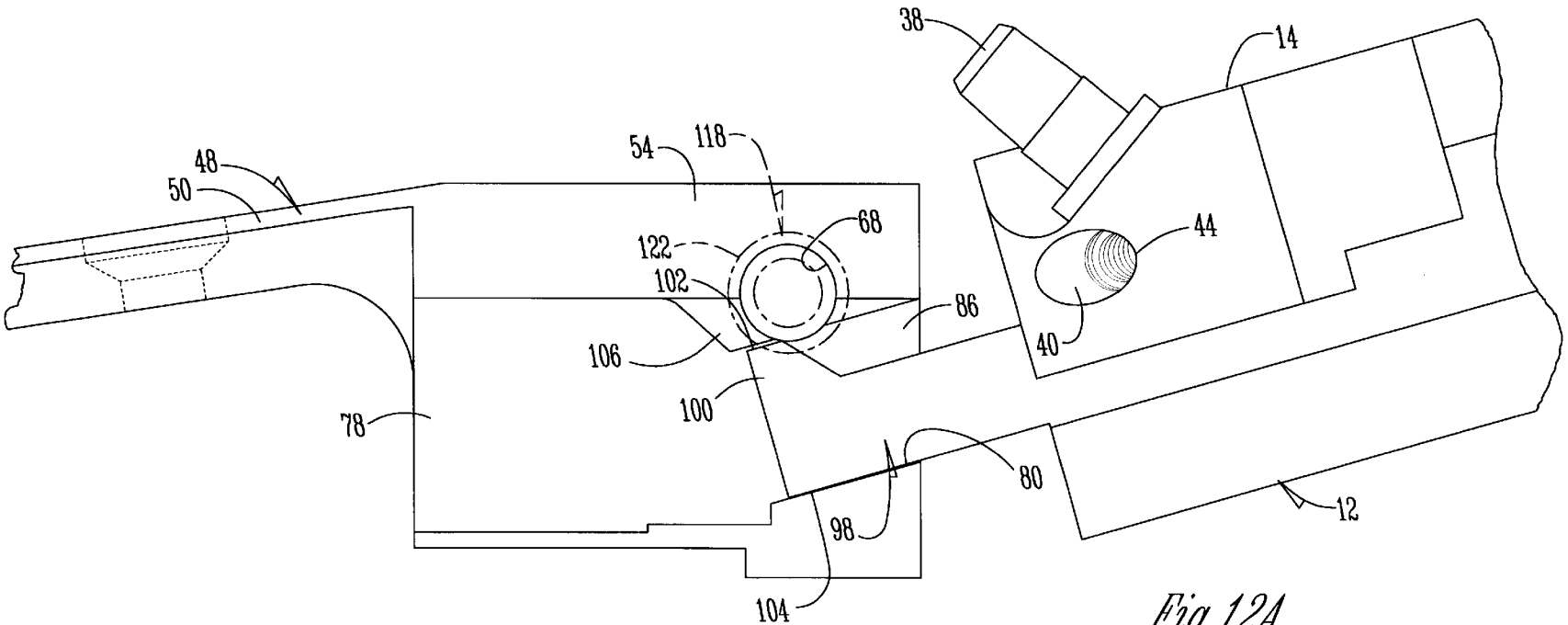
FIG. 12A is a side elevational view similar to that of FIG. 12 but shows the barrel and receiver in a tilted condition with respect to the safety bracket as the barrel is being removed from or inserted into the safety bracket.

As best shown in FIG. 12A, the barrel 12 has at its rearward end adjacent side 58 of body member 54 a barrel tang 98. A tang element 100 is located on the rearward end of barrel tang 98 and has a top edge 102 which is parallel to the bottom edge 104. A shoulder 106 is located in recess 78 immediately adjacent the top edge 102 of the tapered slot 80.

Similarly, the other side of the rearward end of the barrel has a barrel tang 108 adjacent side 60 of recess 84. Tang 108 has a tang element 110 (FIG. 11A) thereon which has a top edge 112 and a bottom edge 114. A shoulder 116 is located in recess 84 immediately adjacent the rearward end of the tapered slot 86.

Figure 13:
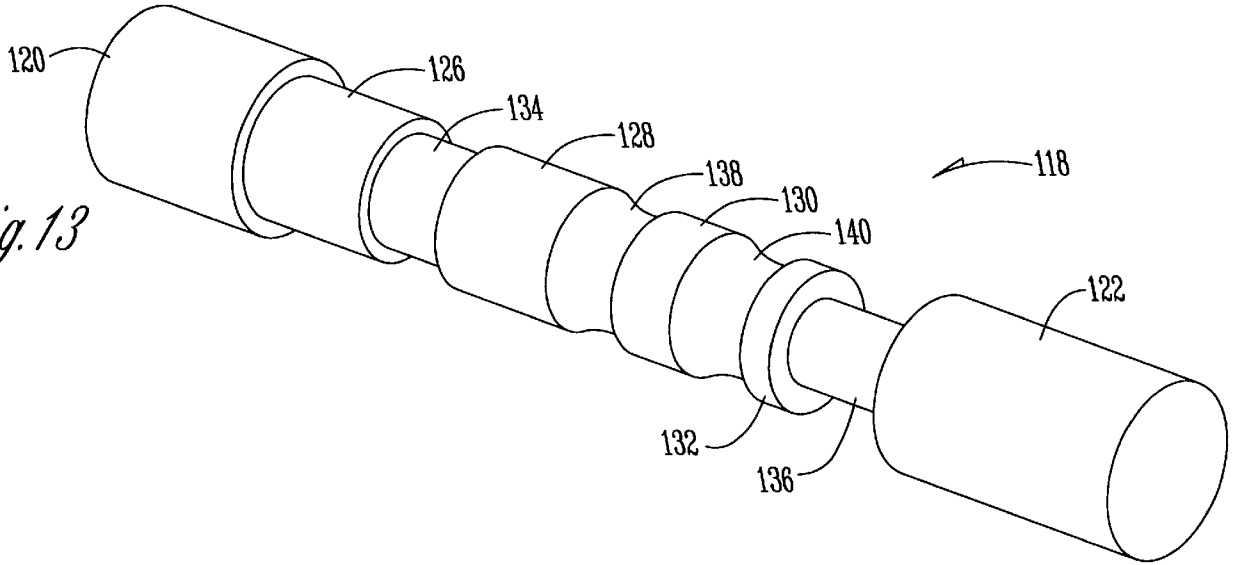
FIG. 13 is an enlarged scale perspective view of the safety bolt.
Figure 14:
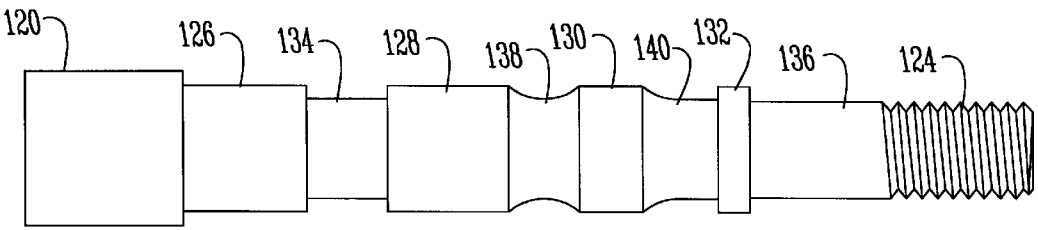
FIG. 14 is a reduced scale elevational view of the safety bolt with the cap being removed from one end thereof.
Figure 16:
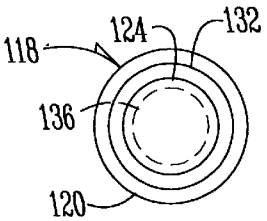
FIG. 16 is an end elevational view of the safety bolt as viewed from the righthand end of FIG. 14.
Figure 15:
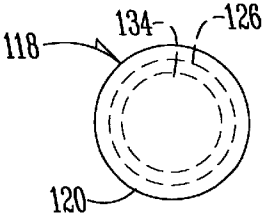
FIG. 15 is an end elevational view of the safety bolt as viewed from the lefthand end of FIG. 14.

A safety bolt 118 of this invention is best shown in FIGS. 13–15. Safety bolt 118 has a hammer engaging end 120 which has a major diameter, and the cap 122 on the opposite end of a similar diameter which is mounted on threaded portion 124 and is preferably adhered thereto upon being mounted thereon.

The safety bolt 118 (FIGS. 13, 14) has cylindrical portions 126, 128, 130 and 132 which are of intermediate diameter and less than the diameters of elements 120 and 122. The cylindrical portions are spaced apart as will be described hereafter. Cylindrical portions 134 and 136 are located between cylindrical portions 126 and 128, and portions 132 and the threaded portion 124. A concave annular groove 138 is located between portions 128 and 130. A semi-concave annular groove 140 is located between portions 130 and 132.

Figure 2A:
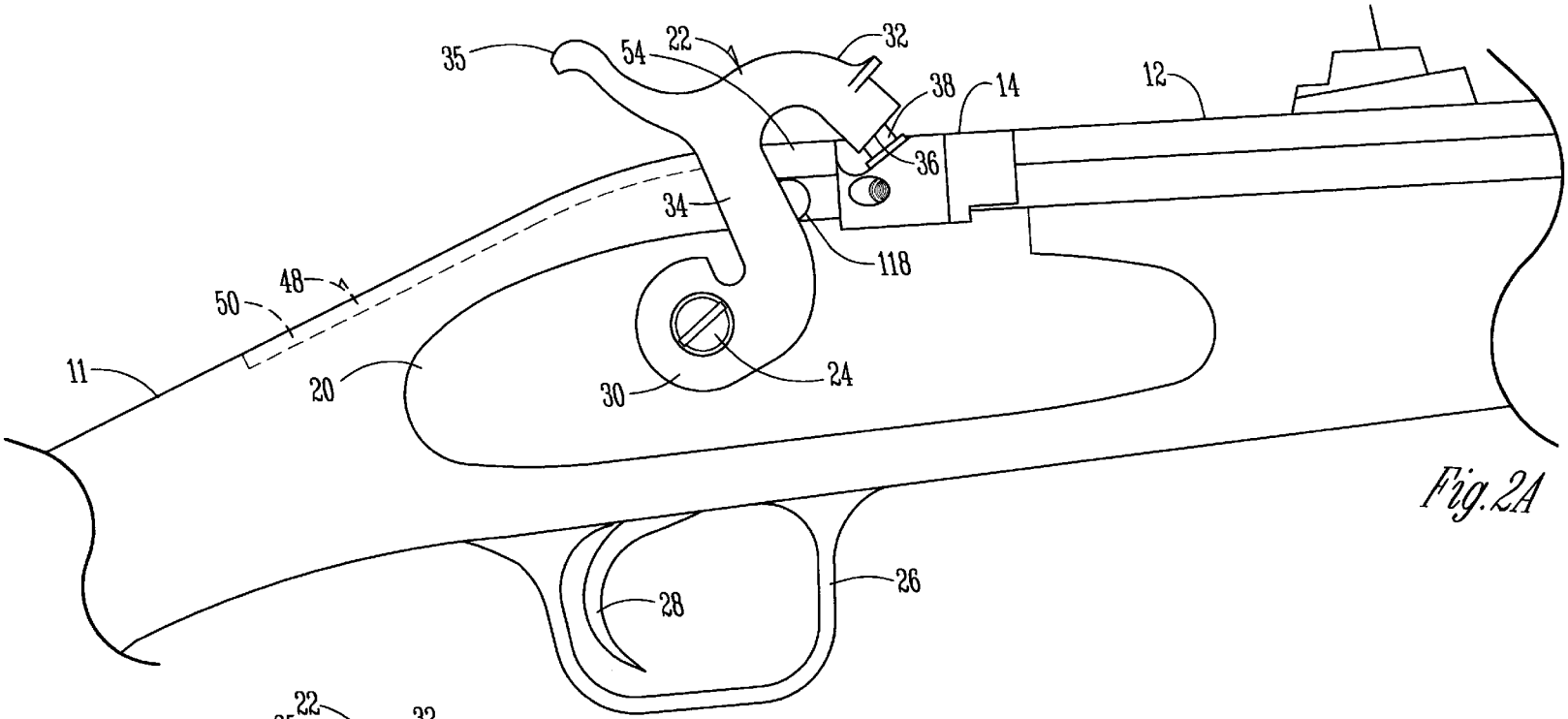
FIG. 2A is a side elevational view similar to FIG. 2 but shows the side hammer in a forward non-safety position.

In operation, the rifle 10 is conventionally made ready for use when the side hammer 22 is in its uncocked position of FIG. 2A. The powder is introduced through the muzzle of the barrel 12 when the rifle is in a vertical position. The powder penetrates the flash passage 40 and is in communication with the lower end of the nipple 38. The projectile to be fired is introduced through the barrel and the normal procedures for firing any muzzleloading rifle are thereupon employed to ready the rifle for firing.

The user then manually engages cocking lever 35 to rotate the side hammer 22 in a rearward direction from the position of FIG. 2A to the position of FIG. 2. Manual pressure is thereupon exerted upon the end 122 of safety bolt 118 to push it laterally from the position in FIG. 8 to the position of FIG. 9. This moves the end 120 of the safety bolt 118 into the pivotal path of the side hammer 22 which prevents it from rotating forwardly to the firing position in the event that it is released for pivotal movement by the trigger mechanism.

It should be noted that when manual pressure is exerted longitudinally on the bolt 118 as described above, the detent 90 is momentarily compressed on spring 94 from the initial position in FIG. 19, to reengage the surface 140 in bolt 118 upon assuming the safety position of FIG. 18. Thus, the displacement of the bolt 118 from the non-safety position of FIG. 19 to the safety position of FIG. 18 involves longitudinal displacement equal to the distance between the centers of annular grooves 138 and 140. The concave or semi-concave shapes of annular grooves 138 and 140, respectively, facilitate the vertical displacement of the detent 90 over the cylindrical surface 130 while the bolt 118 is subjected to longitudinal displacement.

Figure 8:
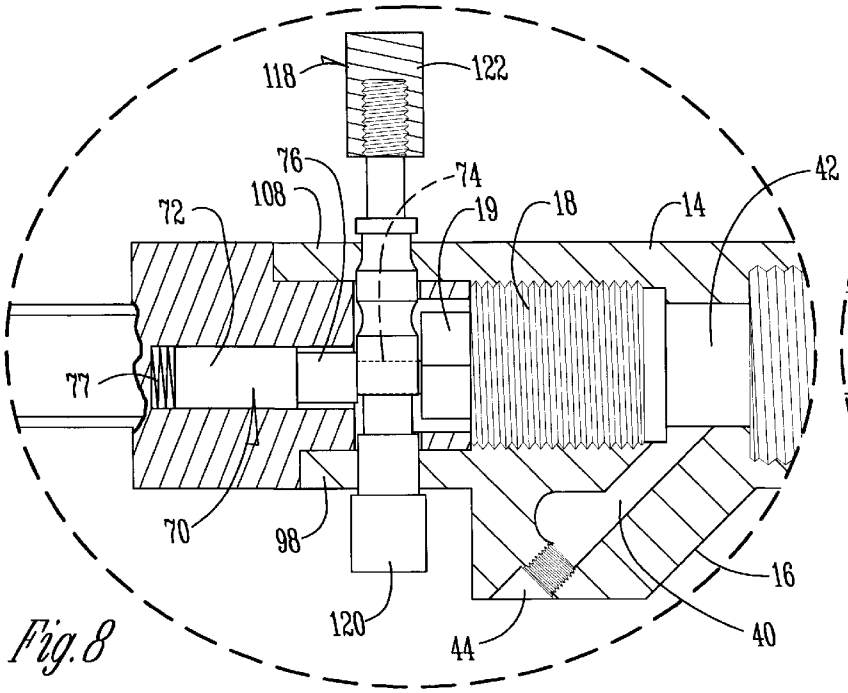
FIG. 8 is an enlarged scale sectional view taken on line 8—8 of FIG. 6.
Figure 11:
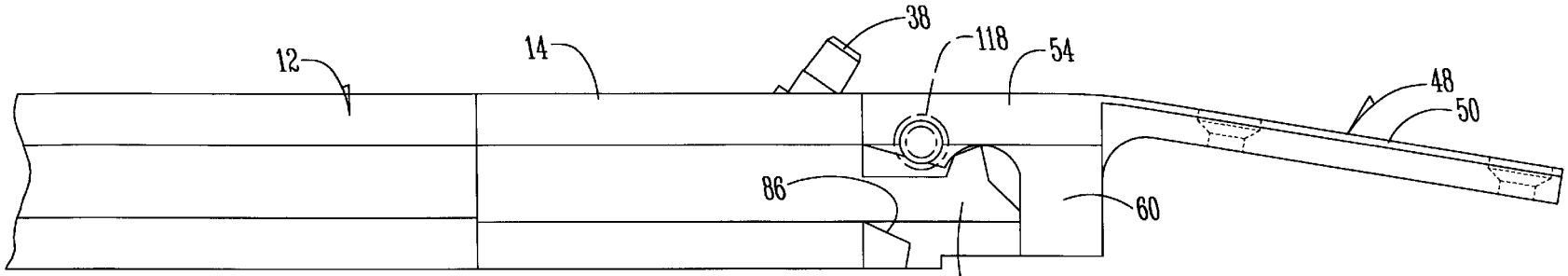
FIG. 11 is a side elevational view of the safety bracket attached to the barrel and receiver on the side of the rifle opposite to the side hammer.
Figure 11A:
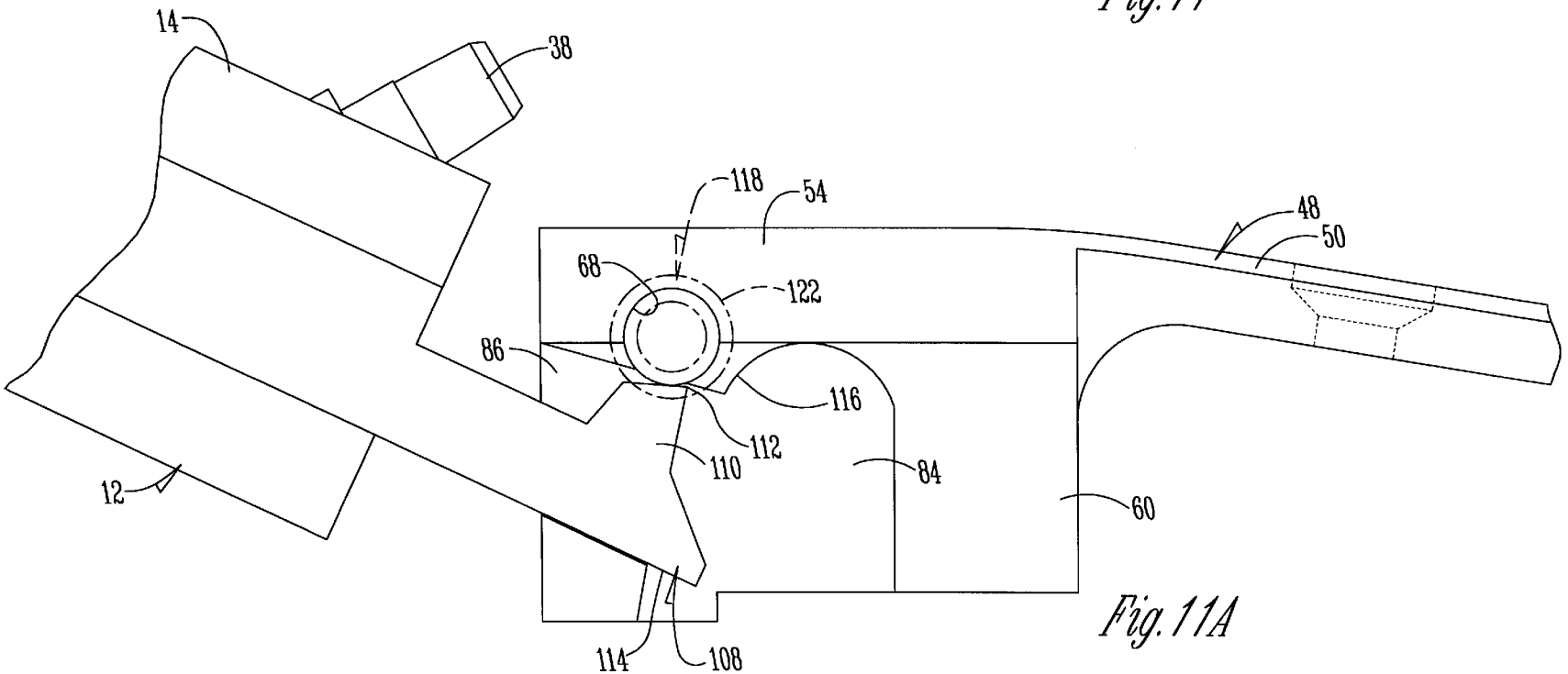
FIG. 11A is a large scale side elevation similar to that of FIG. 11 but shows the barrel in a tilted position when it is being removed from or inserted into the safety bracket.

The rifle barrel 12 is removed from the safety bracket 48, and replaced thereon, by tilting the barrel as shown in FIGS. 11A and 12A. This permits the barrel tangs 98 and 108 to slide with respect to the tapered slots 80 and 86, respectively, to move past the shoulders 106 and 116. However, since it is not desirable to ever remove the barrel 12 unless the safety bolt 118 is in the safety position, the bolt 118, when in the non-safety position (e.g., FIG. 19) prevents the barrel from either being removed or replaced under those conditions. With reference to FIG. 8, it is seen that when the bolt 118 is in the non-safety position, the intermediate diameters of portions 126 and 130 will protrude into the recesses 78 and 86 and will not allow clearance for the barrel tangs 98 and 108 to slide through the tapered slots 80 and 86 to effect either removal or reinsertion of the barrel with respect to the body member 54.

Similarly, as discussed above, it is not desirable to ever have the breech plug 18 removed when the safety is off, because it would be extremely dangerous if the rifle was fired when the breech plug 18 was not in place. With reference to FIGS. 6A and 7A, when the breech plug 18 is in place, nut 19 engages the forward end of plunger 70 (small end 74) and pushes the plunger 70 rearwardly against spring 77. This disengages intermediate center portion 76 from engagement with portion 138 of safety bolt 118, to free the bolt 118 to lateral movement because the small diameter portion 74 is moved underneath the bolt and cannot engage any of the portions of reduced diameter on the bolt to hold it against lateral movement. However, if nut 19 is not present because the breech plug 18 is removed, the spring 77 pushes the plunger 70 forwardly as shown in FIG. 7A. This causes the intermediate portion of the plunger 76 to enter into locking engagement with the bolt 118 at annular groove 138, thus preventing the bolt to be moved from the safety position of FIG. 7A, to the non-safety position of FIG. 6A.

Thus, from the foregoing, it is seen that this invention will accomplish at least all of its stated objectives.

What is claimed is:

1. An improvement in a muzzleloading rifle having an elongated barrel, a receiver assembly at a rearward end of the barrel, a stock portion supporting the barrel and receiver assembly, a trigger mechanism associated with a firing mechanism which includes an exterior firing hammer pivotally secured to a side of the rifle and laterally positioned with respect to the receiver assembly, the improvement comprising, the firing hammer being pivotally mounted on the rifle and being movable between a rearward cocked position and a forward firing position and being releasably held by the trigger mechanism in the cocked position when manually moved to the cocked position, the firing hammer including an arm portion extending away from the pivotal connection between the hammer and the rifle, an elongated safety bolt slidably mounted in a transverse direction in the rifle and being movable between an outer safety position and an inner non-safety position, and being located in the outer position within a pivotal path of the arm portion of the hammer to engage the arm to prevent the forward rotation of the hammer to move to the firing position if the hammer is released for forward pivotal movement by the trigger mechanism, the safety bolt being selectably manually slidable into the rifle by the user to remove it from the safety position in the pivotal path of the arm portion so as to permit the hammer to pivot towards the firing position when released by the trigger assembly.

2. The muzzleloading rifle of claim 1 wherein the safety bolt has a first end which projects laterally outwardly from the rifle to engage the firing hammer when the bolt is in the safety position.

3. The muzzleloading rifle of claim 2 wherein the safety bolt has a second end opposite to the first end which projects outwardly from the rifle away from the firing hammer when the safety bolt is in its non-safety position to facilitate the application of lateral manual pressure on the safety bolt to return the safety bolt to the safety position.

4. The muzzleloading rifle of claim 1 wherein the safety bolt has at least two annular grooves therein, and a spring loaded detent is in the rifle to yieldingly enter one of said grooves when aligned with the detent to yieldingly limit the sliding movement of the safety bolt to the lateral distance between the annular grooves.

5. The muzzleloading rifle of claim 2 wherein the safety bolt has at least two annular grooves therein, and a spring loaded detent is in the rifle to yieldingly enter one of said grooves when aligned with the detent to yieldingly limit the sliding movement of the safety bolt to the lateral distance between the annular grooves.

6. The muzzleloading rifle of claim 3 wherein the safety bolt has at least two annular grooves therein, and a spring loaded detent is in the rifle to yieldingly enter one of said grooves when aligned with the detent to yieldingly limit the sliding movement of the safety bolt to the lateral distance between the annular grooves.

7. The muzzleloading rifle of claim 4 wherein the bolt is slidably moved the lateral distance between the centers of the grooves when being moved between the safety and non-safety positions.

8. The muzzleloading rifle of claim 1 wherein the safety bolt is mounted in a safety bracket on the stock.

9. The muzzleloading rifle of claim 8 wherein the safety bolt has a plurality of spaced annular surfaces thereon slidably mounted in a lateral bore in the safety bracket, the barrel and receiver assembly being detachably secured to the safety bracket by a pair of tangs on the barrel slidably mounted in recessed slots in the safety bracket with the slots partially intersecting the lateral bore, with the safety bolt presenting annular surfaces in alignment with the tangs to permit slidable movement of the tangs in the recessed slots only when the safety bolt is in the safety position.

10. The muzzleloading rifle of claim 8 wherein a breech plug has a rearwardly protruding plug located within the receiver assembly, a spring loaded plunger in the safety bracket having a forward end engaging the plug, the plunger having a forward end of small diameter extending forwardly past the safety bolt and being incapable of interfering with the lateral movement of the bolt, the plunger having a second portion of greater cross sectional size than the forward end of the plunger and adapted to engage the safety bolt and hold it against lateral movement whenever the second portion moves into contact with the safety bolt by reason of the absence of the plug holding the forward end of the plunger out of contact with the bolt.

* * * * *